US006951832B2

(12) United States Patent
Kuroki et al.

(10) Patent No.: US 6,951,832 B2
(45) Date of Patent: Oct. 4, 2005

(54) IMAGE FORMING METHOD UTILIZING THERMAL TRANSFER INTERMEDIATE TRANSFER MEDIUM

(75) Inventors: Takaaki Kuroki, Hachioji (JP); Tatsuichi Maehashi, Tokyo (JP)

(73) Assignee: Konica Corporation, Tokyo (JP)

( * ) Notice: Subject to any disclaimer, the term of this patent is extended or adjusted under 35 U.S.C. 154(b) by 130 days.

(21) Appl. No.: 10/400,816

(22) Filed: Mar. 27, 2003

(65) Prior Publication Data

US 2003/0188822 A1 Oct. 9, 2003

(30) Foreign Application Priority Data

Apr. 8, 2002 (JP) ..... 2002-104919

(51) Int. Cl.[7] ..... B41M 5/40

(52) U.S. Cl. ..... 503/227; 156/235; 428/32.51; 430/945

(58) Field of Search ..... 156/235; 428/32.51; 430/945; 503/227

(56) References Cited

U.S. PATENT DOCUMENTS 5,053,381 A * 10/1991 Chapman et al. ..... 503/227
5,217,793 A 6/1993 Yamane et al.
5,298,308 A * 3/1994 Yamane et al. ..... 428/32.51

FOREIGN PATENT DOCUMENTS

| | | |
|---|---|---|
| EP | 0 730 978 A2 | 9/1996 |
| EP | 1 129 862 A1 | 9/2001 |
| WO | WO 01/87634 A2 | 11/2001 |

* cited by examiner

*Primary Examiner*—Bruce Hess
(74) *Attorney, Agent, or Firm*—Frishauf, Holtz, Goodman & Chick, P.C.

(57) ABSTRACT

An image forming method comprising, superimposing an ink sheet on an intermediate transfer medium, the ink sheet comprising a thermally transferable ink layer, and the intermediate transfer medium comprising a support having thereon an interlayer and an intermediate image receiving layer in the order; applying heat in response to an imagewise signal onto the ink sheet to form an ink image on the image receiving layer of the intermediate transfer medium; peeling off the ink sheet from the intermediate transfer medium having the ink image; superimposing a final image forming material on the intermediate transfer medium having the ink image; and applying heat or pressure to the superimposed final image forming material on the intermediate transfer medium so as to transfer the ink image onto the final image forming material, wherein the image receiving layer is imagewise transferred to the final image forming material together with the ink image.

4 Claims, No Drawings

IMAGE FORMING METHOD UTILIZING THERMAL TRANSFER INTERMEDIATE TRANSFER MEDIUM

TECHNICAL FIELD

The present invention relates to an image forming method utilizing a thermal transfer intermediate transfer medium, and particularly relates to an image forming method utilizing a thermal transfer intermediate transfer medium suitable to laser recording type fusing thermal transfer. More particularly, the present invention relates to an image forming method for printing proof utilizing printing paper or a film base material as a final image carrying element, being excellent in sensitivity, solid image quality, reproducibility of fine lines and appearance of a non-image area, as well as having excellent fixing quality and stable densities.

BACKGROUND

In recent years, need of digital color proof (DDCP), particularly in the field of printing, has been increased accompanied with pervasion of an image forming technology from digital data.

In such DDCP, color reproducibility and stable reproducibility of printed matter are required and a laser thermal transfer technique has been adopted. Concretely, a technique, in which utilizing an ink sheet for laser thermal transfer, comprising a photo-thermal conversion layer and a colorant layer, and an image receiving sheet for laser thermal transfer, comprising an image receiving layer which receives an ink layer of the ink sheet and a layer capable of being softened by heat (thermally softening layer), and facing an ink layer surface of the above-described ink sheet to an image receiving layer surface of the above-described image receiving sheet, laser exposure from the ink sheet side is performed to thermally transfer an ink layer to an image receiving layer side by photo-thermal conversion and further to thermally transfer an image from an image receiving sheet carrying the image to a final image carrying element, has been disclosed.

Such a type of DDCP is able to output a final image on the same paper as printed matter, and is preferred because being applicable as a final proof sample in respect to providing a halftone output and utilizing printing pigments and printing paper for production. Further, various kinds of paper are utilized in printing, including such as art paper, coated paper, matte paper, slightly coated paper and uncoated paper.

Recently, there is increasing desire to utilize DDCP such as described above for a wider range of paper kinds. Corresponding to such desire, a technique, in which transfer property of from matte paper to wood free paper is improved by improving physical property of a thermally softening layer, is disclosed in Japanese Patent Publication Open to Public Inspection No. 2001-138648. However, a desired level of customers for a proof corresponding to printed paper for production means not only to being transferred on paper, but also how much similar is the paper to a printed mater with respect to both of image/non-image portions.

Many conventional techniques to control gloss relating to the following (1) to (3) are disclosed by such as an applicant of the present invention:

(1) A so-called ink-on recording method in which only an ink image is transferred to a final image carrying element after the ink image having been formed on an intermediate transfer medium, (2) A method in which by enhancing thermal deform property of an intermediate transfer medium to increase the following ability to paper at the time of retransfer, a non-image portion of a proof being made to simulate the non-image portion of printing paper as it is, (3) In a method of transferring an ink image together with a receiving layer, a method and a material, in which the surface of a receiving layer being roughened to simulate a non-image portion of a final image carrying element.

However, in an ink-on recording method of (1), there is a problem that gloss of an image portion is decreased due to an image portion being roughened at the time of retransfer and delamination, resulting in poor quality with respect to paper having high gloss such as art paper. In a method of (2), there are two problems to be solved. Firstly, to enhance thermal deform property without having a delaminatable intermediate layer which hardly causes thermal deformation, results in making a delaminating operation heavy and a final image carrying element being damaged in a quite high probability, because delamination surface follows the roughness of paper when an image is transferred to and delaminated from a final image carrying element. Secondly, with respect to paper having a smooth surface such as art paper, the surface gloss is not decreased as the surface of paper even with powerful heat and pressure, which is not preferable in respect to quality. In a method of (3), even with smooth art paper, gloss of a non-image portion can be adjusted to the same level as that of an aimed final image carrying element, more suitably than in a method of (2), without causing a damage in a image portion, since transfer is performed together with a roughened receiving layer. Therefore, the method is preferred in respect to adjusting gloss.

Further, various capability items other than gloss are required for such an intermediate transfer medium. For example, writing speed is an important item and increased sensitivity is also very frequently required. In view of these respects, an intermediate transfer medium having a roughened surface of such as a method of (3) described above can not be denied to be disadvantageous.

Further, as approach from a system in respect to writing speed, a method in which plural lasers are arranged in an alley to achieve high-speed writing is widely utilized in practical use. A solid image recorded by means of such a method may exhibit an uneven solid image quality, due to an effect of distribution of laser light intensity and an effect of a head period. In respect to such a phenomenon, a method of (3) was disadvantageous. That is, there was a problems to be solved that, because the moving distance of ink layer being transferred is large, unevenness depending on a laser alley unit is liable to occur due to a delicate difference in such as a cut of ink and a state of heating.

SUMMARY

The object of the present invention is to provide an image forming method as proof for printing utilizing a final image carrying element made of such as printing paper and a film base material, being excellent in sensitivity, a transport property, and in a transfer state of an image portion and of a non-image portion, as well as having excellent fixing property and gloss of a non-image portion.

The object of the present invention described above has been achieved by the following embodiments.

(1) According to one embodiment of the present invention, an image forming method is provided. The method comprising the steps of:

(a) superimposing an ink sheet on an intermediate transfer medium, the ink sheet comprising a thermally transferable ink layer, and the intermediate transfer medium comprising a support having thereon an interlayer and an intermediate image receiving layer in the order;

(b) applying heat in response to an imagewise signal onto the ink sheet so as to form an ink image on the image receiving layer of the intermediate transfer medium;

(c) peeling off the ink sheet from the intermediate transfer medium having the ink image;

(d) superimposing a final image forming material on the intermediate transfer medium having the ink image; and (e) applying heat or pressure to the superimposed final image forming material on the intermediate transfer medium so as to transfer the ink image onto the final image forming material, wherein the image receiving layer is imagewise transferred to the final image forming material together with the ink image.

(2) Another embodiment of the image forming method of item (1) is provided, wherein the image receiving layer of the intermediate transfer medium comprises a polymer binder having a molecular weight of 5,000 to 500,000 and an additive compound selected from the group consisting of a wax, a silicone compound, an ester of an aliphatic acid with at least 11 carbon atoms, an amid of an aliphatic acid with at least 11 carbon atoms, an ester of an aromatic carboxylic acid, an ester of phosphoric acid and a fluorinated organic compound.

(3) Another embodiment of the image forming method of item (2) is provided, wherein the additive compound in the image receiving layer is contained in an amount of 3 to 30 weight % based on the total weight of the image receiving layer.

(4) Another embodiment of the image forming method of item (2) is provided, wherein the thermally transferable ink layer of the ink sheet comprises the same polymer binder as in the image receiving layer of the intermediate transfer medium.

(5) Another embodiment of the image forming method of item (2) is provided, wherein the additive compound in the image receiving layer of the intermediate transfer medium is selected from the group consisting of a silicone compound, an amid of an aliphatic acid with at least 11 carbon atoms and an ester of phosphoric acid.

(6) Another embodiment of the image forming method of item (1) is provided, wherein the final image forming material is an actual paper.

DESCRIPTION OF THE PREFERRED EMBODIMENTS

The present invention will be further detailed. A thermal transfer intermediate transfer medium of the present invention is comprising a thermal softening layer, an intermediate layer and an image receiving layer accumulated in this order.

As a support for a thermal transfer intermediate transfer medium of the present invention, utilized is a support well known in the art without limitation. For example, various kinds of paper series such as paper, coated paper, synthetic paper (polypropylene, polystyrene or complex materials comprised thereof laminated with paper); various kinds of plastic films or sheets comprising a single layer or two or more accumulated layers of such as a vinylidene chloride sheet, a ABS resin sheet, a polyethylene terephthalate film, a polybutylene terephthalate film, a polyethylene naphthalate film, a polyallylate film, a polycarbonate film, a polyether ketone film, a polysulfone film, a polyether sulfone film, a polyether imide film, a polyimide film, a polyethylene film, a polypropylene film, a polystyrene film, a stretched nylon film and a polyacetate film; films or sheets comprising various kinds of metals; films or sheets comprising various ceramic series, in addition to metal plates of such as aluminum, chromium and nickel; and a resin-coated paper laminated with or vacuum evaporated with a thin metallic layer are listed.

The thickness of these support is preferably from 30 to 200 $\mu$m and further preferably from 50 to 125 $\mu$m.

A support may be subjected to various processing such as dimension stabilization treatment and anti-static treatment. As an anti-static agent, such compounds described at pages from 875 to 876 in "Chemical Products of 11290", published by Kagaku Kogyonippo Co. can be widely utilized in addition to a cationic type surfactant, an anionic type surfactant, a nonionic type surfactant, a polymeric anti-static agent and electric conductive fine particles. Further, surface modifying techniques conventionally well known can also be utilized.

Next, a thermal softening layer of the present invention will be explained. A thermal transfer intermediate transfer medium of the present invention is required to follow roughness of various kinds of final image carrying elements. For this reason, a thermal softening layer is necessary to have a high fluidity under heat or pressure.

To satisfy such characteristics, a thermal softening layer is a layer having thermal softening property or elasticity (hereinafter, may be referred as cushion property), and materials capable of being softening deformed by heating, materials having a low elasticity or materials having a rubbery elasticity are utilized. In the present invention, as an indication to represent cushion property utilized are modulus of elasticity and penetration. For example, a layer having a modulus of elasticity at 25° C. of around from $9.8\times10^6$ to $24.5\times10^7$ Pa or a layer having a penetration defined in JIS K 2530-1976 of around from 15 to 500 (g) and more preferably around from 30 to 300 (g) has been proved to exhibit cushion property favorable to color proof image formation in graphic arts, however, a required degree of cushion property can be suitably selected since it varies depending on the application purpose of an image.

Materials utilized in a thermal softening layer are preferably ones which exhibit elasticity without fluidity at ordinary temperature while exhibit significant fluidity in a high temperature range exceeding a softening point.

A thermal softening layer preferably provided with a TMA softening point of not lower than 40° C. and more preferably from 40 to 80° C. A TMA softening point is measured by means of TMA (Thermomechanical Analysis). That is, it is determined by observing the phase of a measuring object during a temperature of a measuring object is raised at a constant speed and under a constant weight load being applied. In the present invention, a temperature when the phase of a measuring object starts to change is defined as a TMA softening point. Measurement of a softening point by means of TMA is performed by use of an apparatus such as Thermoflex (produced by Rigaku Denki Co.). For example, by use of Thermoflex, setting a measuring temperature to a range from 25 to 200° C. and a speed of temperature rise to 5° C./min, a temperature when the phase is start to change, with a weight load of 10 g being hooked on a quartz glass pin, is a TMA softening point.

Although preferable characteristics of a thermal softening layer cannot necessarily be defined only by a kind of a material, materials having preferable characteristics themselves include such as a polyolefin resin, a ethylene-vinyl acetate copolymer, an ethylene-ethyl acrylate copolymer, a polybutadiene resin, a styrene-butadiene copolymer (SBR), a styrene-ethylene-butene-styrene copolymer (SEBS), an acrylonitrile-butadiene copolymer (NBR), a polyisoprene resin (IR), a styrene-isoprene copolymer (SIS), an acrylic ester copolymer, a polyester resin, a polyurethane resin, an aclrylic resin, a butyl rubber and polynorbornene. Among them, materials having a relatively lower molecular weight are likely to satisfy requirements of the present invention, however it is not limited thereto in relation to materials. A thermal softening layer can be provided by means of solvent coating, and it can be also prepared by coating in a state of an aqueous dispersion such as a latex or an emulsion. In addition, a water-soluble resin can be utilized. These resins can be utilized alone or in combinations, when necessary.

Further, materials other than those described above can also be provide with preferable characteristics of a thermal softening layer by addition of various kinds of additives. These additives include a low boiling point substance such as wax, a plasticizer, a thermal solvent and a tackifier, etc. A wax series concretely includes vegetable wax such as carnauba wax, wood wax, ouricury wax and esparto wax; animal wax such as beeswax, insect wax, shellac wax and whale wax; petroleum wax such as paraffin wax, microcrystal wax, polyethylene wax, ester wax and acid wax; mineral wax such as montan wax, ozokerite and ceresine, and further other than these wax series, included are higher fatty acids such as palmitic acid, stearic acid, margaric acid and behenic acid; higher alcohols such as palmityl alcohol, stearyl alcohol, behenyl alcohol, marganyl alcohol, myricyl alcohol and eicosanol; higher fatty acid esters such as cetyl palmitate, myricyl palmitate, cetyl stearate and myricyl stearate; an amide series such as acetoamide, propionic acid amide, palmitic acid amide, stearic acid amide and amide wax; and a higher amine series such as stearyl amine, behenyl amine and palmityl amine. Among them, preferable are additives being solid at ordinary temperatures, particularly preferable are those having a melting point of from 40 to 130° C. and furthermore preferable are those having a melting point of from 70 to 110° C.

Plasticizers, thermal solvents and tackifier includes concretely phthalic acid ester, adipic acid ester, glycolate ester, fatty acid ester, phosphoric acid ester, chlorinated paraffin, etc. Further, various kinds of additives such as described, for example, in "Practical Handbook of Additives for Plastics and Rubbers", published by Kagaku Kogyo Co. (1970), can be added.

Such as an addition amount of these additives may be adjusted to an amount required for preferable physical property being exhibited in combination with a thermal softening material as a basic component, and is not particularly limited. However, it is generally preferably not more than 10 weight % and furthermore preferably not more than 5 weight %, based on an amount of a thermal softening layer material.

A forming method of a thermal softening layer includes a method in which the materials described above are dissolved or dispersed as a latex in solvents and coated by use of such as a blade coater, a roll coater, a bar coater, a curtain coater and a gravure coater, in addition to an extruding lamination method by means of hot-melt. Further, as a specific thermal softening layer, a resin layer comprising a void structure being constituted by foaming a thermal softening or thermoplastic resin, can be utilized.

A layer thickness of a thermal softening layer is preferably not less than 5 μm and more preferably not less than 10 μm. In case that a layer thickness of a thermal softening layer is less than 5 μm, hollows and cracks may be generated at the time of re-transfer of an image to a final image carrying element.

A thermal transfer intermediate transfer medium of the present invention is characterized in having a point of an intermediate layer surface being most roughened, and a thermal softening layer surface is preferably smooth in respect thereto. However, another point of the present invention is that surface property of an intermediate layer is rougher than that of an image receiving layer. Therefrom, surface property of a thermal softening layer is not limited at all, and can be suitably determined with respect to an intermediate layer.

A friction coefficient of a thermal softening layer surface is preferably from 0.1 to 3 and more preferably from 0.15 to 2. Further, a surface roughness Ra is preferably from 0.01 to 5 μm, more preferably from 0.03 to 3 μm and specifically preferably from 0.05 to 1 μm.

Next, an intermediate layer will be explained.

An intermediate layer of the present invention is a layer which significantly contributes to gloss adjustment. An embodiment of decreasing gloss includes the following four methods:

(1) A matting agent is included in a binder,
(2) A non-miscible resin is mixed as a binder,
(3) A smooth resin layer is formed and the surface thereof is embossed,
(4) A cohesive force of an intermediate layer is designed to be lower than a cohesive force/inter-layer adhesion force and an intermediate layer is cohesively ruptured.

These will be explained in succession below.

(1) A binder includes concretely polyolefin, a silicone resin, polyester, polyvinyl acetal, polyvinyl formal, polyparabanic acid, polymethylmethacrylate, polycarbonate, ethylcellulose, nitrocellulose, methylcellulose, carboxymethyl cellulose, hydroxypropyl cellulose, polyvinyl alcohol, polyvinyl chloride, an urethane resin, a fluorine-contained resin, a styrene cerise such as polystyrene and acrylonitrile styrene, cross-linked compounds thereof, polyamide, polyimide, polyether imide, polysulfone, polyether sulfone and a thermo-curable resin such as aramid and a cured substance thereof. As a curing agent, a general curing agent such as isocyanate and melamine can be utilized. Among them, preferable is a resin having a Tg (glass transition temperature) of not lower than 65° C. and a cross-linked substance thereof. Preferable resin includes polycarbonate, acetal, ethyl cellulose, methyl cellulose and hydroxymethyl cellulose.

Further, a resin preferably utilized is required to have a tension strength of from 1 to 1000 Mpa and more preferably from 2 to 500 Mpa. When tension strength is not more than 1 Mpa, a resin cannot follow up softening of a thermal softening layer, and is difficult to be utilized in manufacturing. While, when it is not less than 1000 Mpa, hindrance to transfer of an image to a final image carrying element becomes large, which is not preferable. Elongation of a resin is preferably from 0.1% to 100%, and a resin cannot follow up softening of a thermal softening layer when it is not larger than 0.1%, and delamination force becomes large at the time of transfer to paper having a large roughness when it is not smaller than 100%, which is not preferable. However, preferable characteristics of a resin are finally those as an intermediate layer, and can be realized by mixing with various kinds of additives.

As a matting agent being added in a binder can be utilized organic or inorganic fine particles. Organic fine particles include fine particles of a radical polymerized polymer such as polymethylmethacrylate (PMMA), polystyrene, polyethylene, polypropylene, etc.; condensed polymer fine particles such as of polyester and polycarbonate; and fine particles of a fluorine-contained resin and a silicone resin. Further preferable is a cross-linked organic fine particles to increase such as strength and solvent resistance of fine particles.

A coating amount of an intermediate layer is preferably from 0.1 to 10 g/m$^2$, more preferably 0.1 to 5 g/m$^2$ and specifically preferably 0.2 to 5 g/m$^2$.

A coating amount of a matting agent is preferably 0.3 to 10 g/m$^2$ and more preferably 0.3 to 5 g/m$^2$. It is necessary to contain not less than 5 mg/m$^2$ of particles of not smaller than 0.3 $\mu$m and more preferably from 6 to 600 mg/m$^2$. A variation coefficient ($\sigma$) of matting agent particle distribution is preferably not more than 0.5, more preferably not more than 0.3 and specifically preferably not more than 0.15.

An addition amount of a matting agent cannot be specified indiscriminately with respect to particle diameter and a coating amount, however, is preferably within a range of from 0.1 to 50 weight % and specifically preferably within a range of from 0.5 to 40 weight %.

A true specific gravity of particles used is not particularly limited, however, preferably from 0.1 to 1.5, more preferably from 0.3 to 1.4 and specifically preferably from 0.5 to 1.3.

A surface roughness Ra (a center-line average surface roughness) of an intermediate layer is preferably from 0.05 to 5 $\mu$m, further preferably from 0.05 to 3.5 $\mu$m and specifically preferably from 0.08 to 2 $\mu$m. A surface roughness Rz (a ten-point average surface roughness) is preferably from 0.3 to 10 $\mu$m, further preferably from 0.5 to 9 $\mu$m and specifically preferably from 0.8 to 8 $\mu$m.

Herein, Ra and Rz are both defined by JIS surface roughness (B0601), and are generally utilized in the art as parameters presenting surface smoothness.

Such as a mold-releasing agent, an electric conductive agent, a surfactant, an anti-oxidant and a UV absorbent are preferably added in an intermediate layer when necessary. Among them important is a mold-releasing agent, and it is a preferable embodiment in which various kinds of mold-releasing agents, well known in the art, are added in an intermediate layer to provide an optimum delamination strength, since delaminating force has a tendency to increase corresponding to the increase of a delaminating surface area. A mold-releasing agent is preferably of minimal migration property to an image receiving layer in case of an image receiving layer is provided. Thereby, change of an ink transfer property due to migration is prevented.

A delamination strength of an intermediate layer means a delamination strength between an intermediate layer and an image receiving layer at the time of transfer of an image and an image receiving layer to a final image carrying element in an image forming method described below.

In the present invention, delamination strength of an intermediate layer is preferably from $9.8\times10^{-3}$ to 1.96 N/cm, more preferably from $9.8\times10^{-3}$ to 0.98 N/cm and specifically preferably $9.8\times10^{-3}$ to 0.49 N/cm. The value is preferably a similar value in various kinds of a final image carrying element.

As an embodiment (2), non-miscible resins are preferably blended at a ratio of from 30/70 to 50/50 (weight ratio). Further, resins having SP values of being different each other by not less than 1 and preferably by not less than 2 are preferably blended, and a molecular weight of a resin is not less than 10,000 and preferably not less than 50,000.

Further, a combination of a solvent and a polymer emulsion utilizing a solvent similar thereto is also effective to realize non-miscible mixture of the present invention.

In embodiment (3), resins utilized are preferably ones having thermoplastic property among above-described resins. Wherein, a TMA softening point, which has been referred with respect to a thermal softening layer, is preferably not lower than 100° C., more preferably not lower than 120° C. and specifically preferably from 140 to 200° C. Resins having a TMA softening point of lower than 100° C. are not preferable in respect to storage property, while resins having that of over 200° C. are difficult to be subjected to embossing treatment.

A method for embossing is effectively performed by heating treatment and pressing treatment, and the surface property is preferably changed by means of such as heat/press rollers.

Embodiment (4) is characterized in that an intermediate layer itself perform cohesive delamination in a process of secondary transfer of an image to a final image carrying element, after exposure; and techniques well known in the art which can provide such a constitution can be utilized without specific limitation.

For example, there listed are such as a method in which a supercooling substance is contained in an intermediate layer and the layer is delaminated immediately after heating, a method in which cohesive force of a layer is lowered by blending a non-miscible resin as described in the constitution of (2), a method in which cohesive force of a layer is lowered by adding a low melting point compound such as wax in a resin, a method in which a cohesive rupturing delamination layer is provided by bleeding out of wax, and a method in which utilizing a resin system capable of starting depolymerization by exposure to cause cohesive rupture by delamination after exposure.

A supercooling substance includes poly-$\epsilon$-caprolactone, polyoxyethylene, benzotriazole, tribenzylamine, vanillin, etc. Further, in an intermediate layer of other constitution, a substance which lowers adhesive property with an image receiving layer is contained. Such a substance includes silicone type resins such as silicone oil; fluorine-contained resins such as Teflon (R) and a fluorine-contained acrylic resin; polysiloxane resin; acetal resins such as polyvinyl butyral, polyvinyl acetal and polyvinyl formal; solid wax series such as polyethylene wax and amide wax; and surfactants such as of a fluorine type and of a phosphoric acid ester type. Wax described with respect to a thermal softening layer can be preferably utilized.

Further, adhesive force between an under-coating layer (a thermal softening layer) and an image receiving layer is necessary to be sufficient to perform cohesive rupture, and it is important to select a resin having good affinity with an under-coating layer and an image receiving layer.

As a method to form an intermediate layer, such as a coating method by use of a blade coater, a roll coater, a bar corter, a curtain coater, a gravure coater, etc., and an extruding lamination method by means of hotmelt can be applicable to the above-described materials being dissolved, or dispersed to make a latex state, in a solvent. Further, there is a method in which a coating of the above-described materials being dissolved, or dispersed to make a latex state, in a solvent having been coated on a tentative base by means of the above-described method, and a thermal softening layer are laminated, followed by delaminating the tentative base.

Next, an image receiving layer will be explained. An image receiving layer is comprising a binder and various kinds of additives being incorporated when necessary. An image receiving layer of the present invention significantly contributes to exposure characteristics and gloss keeping property.

In an image receiving layer, a binder of the same kind as those utilized in an ink layer is preferably contained; wherein, a binder of the same kind in the present invention means to have the same skeleton and means homology of arange such as so-called a styrene type, an acrylic type, a butyral type, an acetal type, an urethane type, a polyester type, a polyolefin type, a silicone type and a cellulose type resins, and among them are preferable are a styrene type, an acrylic type and a butyral type resins. These polymers are preferably contained as a main component, and a molecular weight of the polymers is preferably from 5,000 to 3,000,000, more preferably 10,000 to 2,000,000 and specifically preferably 20,000 to 1,000,000.

A binder preferably utilized in an image receiving layer is preferably one having a softening point of not lower than 40° C., more preferably from 40 to 80° C. and specifically preferably from 40 to 70° C., based on TMA measurement. Concrete examples of an image receiving layer binder include adhesives such as a polyvinylacetate emulsion type adhesive, a chloroprene rubber type adhesive and an epoxy resin type adhesive, tacky agents of such as natural rubber, a chloroprene rubber type, a silicone rubber type and a petroleum resin type, regenerated rubber, a vinyl chloride type resin, SBR, a polybutadiene resin, polyisoprene, a polyvinyl butyral resin, polyvinyl ether, an ionomer resin, SIS, SEBS, an acrylic resin, an ethylene copolymer, an ethylene-vinyl chloride copolymer, an ethylene-acrylic acid copolymer, an ethylene-vinyl acetate resin (EVA), a vinyl chloride-grafted EVA resin, an EVA-grafted vinyl chloride resin, a vinyl chloride type resin, an urethane resin, a polyester resin, a polyolefin resin, various kinds of modified olefin, polyvinyl butyral, etc.

In the present invention, specifically preferable binders include polyvinylchloride, polyvinylacetate, an ethylene-vinylacetate copolymer, a vinylchloride-vinylacetate copolymer, an ethylene-acrylic acid copolymer, a polyethylene resin, a polypropylene resin, a polystyrene resin, a styrene-acrylic copolymer, a polyester resin, a polyisobutylene resin, a polybutadiene resin, a polystyrene-butadiene resin, a polychloroprene resin, an acrylic resin, a methacrylic resin, a modified olefin resin, a polyvinyl alcohol resin, a polyvinyl formal resin, a polyvinyl butyral resin, a rosin resin, a maleic acid resin, a styrene-maleic acid resin, a ketone resin, a hydrocarbon resin, etc., and include specifically an acrylic copolymer, an ethylene-vinyl acetate copolymer and 1,2-polybutadiene. The above described binders may be utilize alone or in combinations of two or more kinds.

An image receiving layer preferably contains a matting agent. As materials for a matting agent, those utilized in an intermediate layer described above can be suitably used as well. A number average particle diameter of a matting agent is preferably larger than an average layer thickness of the portion where a matting agent does not present by from 0.3 to 10.0 μm and further preferably by from 0.3 to 8.0 μm. Among them, those being larger by from 1 to 5.5 μm are effective and specifically preferable. Those smaller than 0.3 μm exhibit little effect to fogging and gas elimination, while those over 10.0 μm exhibit deterioration of sensitivity. Moreover, preferable is those having a distribution in which a weight of particles having a particle diameter of not less than 2 times of a number average particle diameter is not more than 20% and more preferable is those having a distribution in which a weight of particles having a particle diameter of not less than 2 times of a number average particle diameter is not more than 5%. Since a matting agent having a distribution, in which a weight of particles having a particle diameter of not less than 2 times of a number average particle diameter is not more than 20%, can relax pressure uniformly, deterioration of storage property such as blocking can be prevented. Utilizing a matting agent having a distribution in which a weight of particles having a particle diameter of not less than 2 times of a number average particle diameter is not more than 5% is further preferable in respect to storage property. In case of selecting such a matting agent, since amount of matting agent is too large to make an image yellowish when a binder thikness of an image receiving layer is not less than 3.0 μm, a binder layer thickness of an image receiving layer is preferably from 0.8 to 3.0 μm.

A distribution of a matting agent on the surface of an image receiving layer is also important. A number of a matting agent on an image receiving layer is preferably from 100 to 2,400 particles/mm$^2$. Further, a matting agent having a true spherical shape enables capability improvement by addition of a matting agent to be more efficient. A true spherical shape indicates that a shape of a matting agent observed through such as a microscope is almost spherical and a difference between the longest diameter and the shortest diameter is approximately not more than 20%.

A surface roughness of an image receiving layer Ra (a center-line average surface roughness) is preferably from 0.01 to 0.4 μm, further preferably from 0.01 to 0.2 μm and specifically preferably from 0.01 to 0.15 μm. Further, a surface roughness Rz (a ten-point average surface roughness) is preferably from 0.03 to 5 μm, further preferably from 0.05 to 3.5 μm and specifically preferably from 0.1 to 2.0 μm.

A layer thickness of an image receiving layer is preferably from 0.1 to 5 μm and more preferably from 0.5 to 4 μm.

An elongation percentage of a resin utilized suitably in an image receiving layer is preferably from 1 to 1,000% and more preferably from 10 to 800%. In case of not more than 1%, there may be produced a hollow of a pinhole shape which is not preferred. While, in case of not less than 1,000%, it is not preferable in respect to delamination of a large size sheet due to an increased delamination force.

In an image receiving layer, additives, which are well known in the art, such as an anti-oxidant, a UV absorbent, an anti-septic agent, a surfactant and an anti-static agent can be utilized when necessary.

To achieve an image receiving layer of a cohesive rupturing type, a method similar to the above-described embodiment (4) for decreasing gloss of an intermediate layer is applicable. An addition amount of an additive is preferably from 1 to 50 weight %, more preferably from 2 to 40 weight % and specifically preferable from 3 to 30 weight %, because an image receiving layer is required to be provided with ink affinity.

Within the above-mentioned ranges, it can be well achieved to transfer only the image portion in the intermediate image receiving layer onto the final image forming material. This leads to yielding a good image quality. When the additive incorporated in the image receiving layer is less than 3 weight %, transferring ability is decreased. Further, when the additive is less than 1 weight %, the difference of transferring ability between the image portion and the non-image portion is hardly achieved and consequently the fixing of image onto the final image forming material cannot be achieved. When the additive is more than 30 weight %, the whole portion of the intermediate image receiving layer is transferred to the final image forming material resulting in failing to give a good appearance to the non-image forming portion.

Further, it is important to select a resin having a good affinity with an under-coating layer (an intermediate layer) and ink, because an image receiving layer is required to be provided with a sufficient adhesive force with an under-coating layer and ink to perform cohesive rupture.

A layer thickness of an image receiving layer of a cohesive rupturing type is preferably from 0.8 to 10 μm, further preferably from 1.2 to 8 μm and specifically preferably from 1.6 to 6 μm.

In the present invention, an embodiment in which a back-coating layer is provided on the back surface (an opposite side to the surface being provided with an image receiving layer) of the above-described support is preferable, to present functions of such as transport property, heat-resistance and anti-static property. Further, to provide a back-coating layer is also effective to depress image defects and enhance stability of image quality.

A back-coating layer can be formed by coating a back-coating layer coating solution, in which a binder resin is dissolved in solvents, or a binder resin and a matting agent having a particle diameter of from 2 to 30 μm are dissolved or dispersed in solvents, on the back surface of a support.

As a binder utilized in a back-coating layer, can be utilized popular polymers such as gelatin, polyvinyl alcohol, methyl cellulose, nitro cellulose, acetyl cellulose, an aromatic polyamide resin, a silicone resin, an epoxy resin, an alkyd resin, a phenol resin, a melamine resin, a fluorine-contained resin, a polyimide resin, an urethane resin, an acrylic resin, an urethane modified silicone resin, a polyethylene resin, a polypropylene resin, a polyester resin, Teflon (R) resin, a polyvinyl butyral resin, a vinyl chloride type resin, polyvinyl acetate, polycarbonate, an organic boron compound, an aromatic ester series, polyurethane fluoride and polyethersulfone. To utilize and cross-link a cross-linking water-soluble binder as a binder of a back-coating layer, is effective to prevent powdery drop-off of a matting agent and to improve anti-abrasion property of a back-coating layer. Further, it is also specifically effective to prevent blocking during storage. As a cross-linking means can be utilized any one of or combinations of heat, actinic lay and pressure, depending on characteristics of a cross-linking agent being utilized. Depending on a case, an arbitrary adhesive layer may be provided on the back-coating side of a support to provide a support with adhesive property.

A back-coating layer preferably has an anti-abrasion strength of not less than 10 g (from 10 to 500 g) and more preferably not less than 20 g (from 20 to 500 g), based on a measurement by a scratch tester with a 0.1 mm R needle.

Scratch test is performed according to the following method. That is, a back-coating layer is provided on a support and the measurement is performed after the sample having been kept under an environment of 23° C. and 50% RH for one day. The measurement was performed by use of a scratch strength tester HEIDON-18 (produced by HEIDON Co.) as a measurement device, and a measurement needle was a sapphire needle having 0.1 mm R. In the measurement, a 10 cm long scratch test at a constant loading weight was repeated three times and a limiting loading weight at which no abrasion mark reaching a support was present was defined as a scratch strength.

Further, as described above, it is preferable to contain a matting agent in a back-coating layer.

Next, an ink sheet used together with a thermal transfer intermediate transfer medium of the present invention will be explained.

An ink sheet is a film provided with a photo-thermal conversion function and an ink (colorant) transfer function, and is comprising at least a photo-thermal conversion layer having a photo-thermal conversion function and an ink layer, on one side of a support, wherein, the both functions may be provided in the same layer.

Further, a cushion layer and a delaminating layer between these layers and a support, an intermediate layer between a photo-thermal conversion layer and an ink layer, and a back-coating layer on the opposite side surface (the back surface) may be provided, when necessary.

A support is any of those having rigidity, good dimension stability and superior smoothness and withstanding heat at the time of image formation, and concretely includes various kinds of paper series such as paper, coated paper, synthetic paper (polypropylene, polystyrene or complex materials thereof laminated with paper); various kinds of plastic films or sheets comprising a single layer or two or more layers accumulated of such as a vinylchloride type resin sheet, an ABS resin sheet, a polyethylene terephthalate film, a polybutylene terephthalate film, a polyethylene naphthalate film, a polyacrylate film, a polycarbonate film, a polyetherketone film, a polysulfone film, a polyether sulfone film, a polyether imide film, a polyimide film, a polyethylene film, a polypropylene film, a polystyrene film, a syndiotactic polystyrene film, a stretched nylon film, a polyacetate film and a polymethylmethacrylate film; films or sheets comprising various kinds of metals, films or sheets comprising various kinds of ceramics, metal plates made of aluminum, stainless steel, chromium and nickel; and resin coated paper being laminated or evaporated with a metal thin layer.

These supports can be provided with various kinds of processing such as dimension stabilization treatment and anti-static treatment. As an anti-static agent, a cationic surfactant, an anionic surfactant, a nonionic surfactant, a polymeric anti-static agent, electric conductive fine particles and compounds such as described at pages from 875 to 876 in "Chemical products of 11290", published by Kagaku Kogyonippon Co., can be widely utilized.

Further, these supports can be provided with surface modifying treatment well known in the art. The surface treatment includes flame emission treatment, sulfuric acid treatment, corona discharge treatment, plasma treatment, grow discharge treatment, etc. Further, an adhesive layer may be provided on the support described above so that each of the following layer can be coated excellently on a support.

A support is preferably transparent in case that laser light is irradiated from an ink sheet side to form an image. A layer thickness is preferably thinner than that of a thermal transfer intermediate transfer medium in respect to easy superimpose; and it is, in general, preferably from 30 to 150 μm and more preferably from 50 to 100 μm.

A photo-thermal conversion layer is a layer provided with a photo-thermal conversion function. In case of a photo-thermal conversion substance being able to be added in an ink layer, a photo-thermal conversion layer is not particularly needed; while in case of a photo-thermal conversion substance is not essentially transparent, a photo-thermal conversion layer other than an ink layer is preferably provided in consideration of color reproduction quality of a transferred image. A photo-thermal conversion layer is preferably provided between a support and an ink layer and more preferably between a cushion layer and an ink layer. As a binder in a photo-thermal conversion layer, a resin having a high glass transition temperature (Tg) and a high thermal conductivity, for example, general heat resisting resins such as polymethyl methaacrylate, polycarbonate, polystyrene, ethyl cellulose, nitro cellulose, polyvinyl alcohol, polyvinyl chloride, polyamide, polyimide, polyether imide, polysulfone, polyether sulfone and aramid; and polymer compounds such as a polythiophene series, a polyaniline series, a polyacetylene series, a polyphenylene series, a polyphenylene-sulfide series, a polypyrrole series, and derivatives thereof or mixtures comprised thereof; can be utilized. Further, as a binder in a photo-thermal conversion layer, a water soluble polymer can be also utilized. A water soluble polymer is preferred in respect to excellent delaminating property with an ink layer, excellent heat resistance at the time of laser irradiation and minimal scattering even with excessive heating. In case of utilizing a water soluble polymer, a photo-thermal conversion substance is preferably modified to be water soluble (by such as introduction of a sulfo group) or dispersed in a water phase. Further, it is also possible to improve delaminating property between a photo-thermal conversion layer and an ink layer and to increase sensitivity, by incorporating various kinds of mold-releasing agents in a photo-thermal conversion layer. As a mold-releasing agent, effective are a silicone type mold-releasing agent (such as polyoxyalkylene modified silicone oil and alcohol modified silicone oil), a fluorine-contained surfactant (such as a perfluorophosphoric acid ester type surfactant) and other various kinds of surfactants. In case of utilizing a photo-thermal conversion substance, although it depends on a light source, a substance capable of absorbing light and converting it into heat efficiently is preferable; for example, when a semiconductor laser is used as a light source, a substance having an absorption band in near infrared is preferable, and as a near infrared absorbent suitably utilized are, for example carbon black, organic substances such as dyes of a cyanine type, a polymethine type, an azulenium type, a squalium type, a thiopyrylium type, a naphthoquinone type and an anthraquinone type; and organic metal complexes of phthalocyanine type, an azo type and a thioamide type; concretely listed are compounds described in such as Japanese Patent Publication Open to Public Inspection Nos. 63-139191, 64-33547, 1-160683, 1-280750, 1-293342, 2-2074 3-26593, 3-30991, 3-34891, 3-36093, 3-36094, 3-36095, 3-42281, 3-97589 and 3-103476. These can be used alone or in combinations of not less than two kinds. A layer thickness of a photo-thermal conversion layer is preferably from 0.1 to 3 $\mu$m and more preferably from 0.2 to 1.0 $\mu$m. A content of a photo-thermal conversion substance in a photo-thermal conversion layer can be generally determined so as to make absorbance at a wavelength of a light source utilized for image recording from 0.3 to 3.0 and more preferably from 0.7 to 2.5. In case that carbon black is used as a photo-thermal conversion layer, there is a tendency of sensitivity decrease instead of no generation of burning due to overheating of an ink layer when a layer thickness of a photo-thermal conversion layer is over 1 $\mu$m, however, layer thickness can be suitably selected depending on such as irradiating laser power and absorbance of a photo-thermal conversion layer.

As a photo-thermal conversion layer, an evaporated layer can be also utilized other than those described above; in addition to carbon black, and an evaporated layer comprising metal black of such as gold, silver, aluminum, chromium, nickel, antimony, tellurium, bismuth and selenium, described in Japanese Patent Publication Open to Public Inspection No. 52-20842; listed are an evaporated layer of a metal element of Ib, IIb, IIIa, IVb, Va, Vb, VIa, VIb, VIIb and VIII groups in the periodic table, and alloys thereof; or an evaporated layer of alloys thereof with an element of Ia, Iia and IIIb groups, or an evaporated layer of mixtures thereof. Specifically preferable metals include Al, Bi, Sn, In or Zn, and alloys thereof, alloys of these metals with an element of Ia, IIa and IIIb groups in the periodic table, and mixtures thereof. As a suitable metal oxide or metal sulfide includes compounds of Al, Bi, Sn, In, Zn, Ti, Cr, Me, W, Co, Ir, Ni, Pb, Pt, Cu, Ag, Au, Zr or Te, or mixtures thereof. Further, an evaporated layer of a metal phthalocyanine series, a metal dithiolene series or a metal anthraquinone series is also listed. A layer thickness of an evaporated layer is preferably within 500 A. Herein, a photo-thermal conversion substance can be also a colorant itself in an ink layer, and various kinds of substances can be utilized without being limited to substances described above. In case that a photo-thermal conversion layer is inferior in adhesion with an under-coating layer of a support; an adhesive layer may be provided between a photo-thermal conversion layer and an under-coating layer of a support because there may cause peeling and color contamination, when a transfer material is delaminated from a thermal transfer intermediate transfer medium, at the time of light irradiation or after thermal transfer.

An ink layer is mainly comprising a colorant and a binder. In a laser fusing thermal transfer method, an ink layer is a layer containing such as a colorant, which is fused or softened at heating, and a binder, and being transferable as a whole layer, and is not necessarily transferred in a completely fused state.

The colorant described above includes, for example, pigments such as inorganic pigments (titanium dioxide, carbon black, graphite, zinc oxide, Prussian blue, cadmium sulfide, iron oxide and a chromate of lead, zinc, barium and calcium, etc.) and organic pigments (pigments of an azo type, a thioindigo type, an anthraquinone type, an anthanthrone type and a triphenedioxazine type; a vat pigment dye, a phthalocyanine pigment and derivatives thereof; a quinacridone pigment; etc.), and dyes (an acid dye, a direct dye, a dispersion dye, an oil-soluble dye pigment, a metal-contained oil-soluble dye, and a sublimation dye, etc.). For example, in case of forming a color proof material, pigments of C.I.21095 or C.I.21090, C.I.15850:1, and C.I.74160 are preferably utilized as yellow, magenta and cyan, respectively.

A content ratio of a colorant in an ink layer may be adjusted so as to obtain a desired density at a desired coating layer thickness, not being particularly limited, however, is generally within a range of from 5 to 70 weight % and preferably from 10 to 60 weight %.

A binder of an ink layer includes such as a thermally fusing substance and a thermoplastic resin. A thermally fusing substance is a solid or semi-solid substance having a melting point, measured by use of Yanagimoto MJP-2 Type, of from 40 to 150° C. Concretely, vegetable wax such as carnauba wax, wood wax, ouricury wax and esparto wax; animal wax such as beeswax, insect wax, shellac wax and whale wax; petroleum wax such as paraffin wax, microcrystal wax, polyethylene wax, ester wax and acid wax; mineral wax such as montan wax, ozokerite and ceresine, and further other than these wax series, included are higher fatty acids such as palmitic acid, stearic acid, margaric acid and behenic acid; higher alcohols such as palmityl alcohol, stearyl alcohol, behenyl alcohol, marganyl alcohol, myricyl alcohol and eicosanol; higher fatty acid esters such as cetyl palmitate, myricyl palmitate, cetyl stearate and myricyl stearate; an amide series such as acetamide, propionic acid amide, palmitic acid amide, stearic acid amide and amide wax; and a higher amine series such as stearyl amine, behenyl amine and palmityl amine.

Further, a thermoplastic resin includes an ethylene type copolymer, a polyamide type resin, a polyester type resin, a polyurethane type resin, a polyolefin type resin, a styrene type resin, a styrene-acrylic type resin, an acrylic type resin, a vinyl chloride type resin, a cellulose type resin, a rosin type resin, a polyvinyl alcohol type resin, a polyvinyl acetal type resin, a polyvinyl butyral resin, an ionomer resin, a petroleum type resin, and resins for an ink layer described in Japanese Patent Publication Open to Public Inspection No. 6-312583, and specifically preferably utilized are resins having a melting point or a TMA softening point of from 70 to 150° C.

Further, other than thermoplastic resins described above, an elastomer series such as natural rubber, styrene butadiene rubber, isoprene rubber, chloroprene rubber and a diene-type copolymer; rosin derivatives such as an ester gum, a rosin maleate resin, a rosin phenol resin and hydrated rosin; and high polymer compounds such as a phenol resin, a terpene resin, a cyclopentadiene resin and an aromatic hydrocarbon resin can be also utilized.

By suitably selecting a thermal fusing substance and a thermoplastic substance, described above, an ink layer provided with thermal transfer property and having a desired thermal softening point or thermal fusing point can be formed.

In the present invention, by utilizing a binder having high thermal decomposition property, an image formation by abrasion transfer is also possible. Such a binder includes polymer substances which cause rapid acid-catalytic partial decomposition at a temperature of preferably not higher than 200° C., being measured under an equilibrium condition, and concretely, includes a nitro cellulose series, a polycarbonate series and a polymers series disclosed at pages 59 to 64 in J. Imaging Science, 30 (2), 1986, by J. M. J Frechet, F. Bouchard, J. M. Houlihan, B. Kryczke and E. Eichler, in addition to a polyurethane series, a polyester series, a polyorthoester series and a polyacetal series, and copolymers thereof. Further, these polymers are detailed together with the decomposition mechanism in the above described report by J. M. Houlihan et al.

Japanese Patent Publication Open to Public Inspection No. 62-158092 discloses that high densities can be obtained by making a particle diameter of a pigment uniform, however, utilizing various kinds of dispersing agents is effective to assure dispersibility of a pigment and to obtain excellent color reproduction.

As other additives, addition of a plasticizer with an intention of increasing sensitivity due to plasticizing of an ink layer, a surfactant to improve coatability of an ink layer and particles of from sub-micron to micron order (a matting agent) to prevent blocking of an ink layer, are possible.

A preferable layer thickness of an ink layer is from 0.2 to 2 μm and further preferably 0.3 to 1.5 μm. It is confirmed specifically that high sensitivity is achieved by setting the layer thickness to not more than 0.8 μm, however, the optimum layer thickness range is selected depending on a balance between sensitivity and resolution and other desired image reproduction abilities because thin layer transfer property of an ink layer varies depending on the kinds of a binder or a colorant used and on the mixing ratio.

An intermediate layer preferably provided between a photo-thermal conversion layer and an ink layer is comprising such as a binder and, when necessary, a cross-linking agent, a sensitizer and a surfactant.

An intermediate layer is considered to increase sensitivity and to minimize change of sensitivity during storage of an ink sheet, by preventing a photo-thermal conversion dye (an infrared absorbing dye in case of utilizing an infrared laser as a light source) contained in a photo-thermal conversion layer from diffusing to an intermediate layer or an ink layer at the time of coating or drying, or during storage after production of an ink sheet. Further, increase of sensitivity can be achieved by addition of a sensitizer or a compound having a boiling point of from 100 to 400° C., in an intermediate layer.

A binder utilized in an intermediate layer differs depending on constitution of a photo-thermal conversion layer, however, a resin soluble in a solvent, having not more than 1% of a solubility for the photo-thermal conversion dye used, can be utilized.

Next, an image forming method of the present invention will be explained.

In an example of a method in which image formation is performed by use of an intermediate transfer type thermal transfer intermediate transfer medium of the present invention, an intermediate transfer type thermal transfer intermediate transfer medium and an ink sheet are set wound on an exposure drum in this order to be held contacting under a reduced pressure, a laser beam being irradiated according to image data from the backside (the side of a back-coating layer having been coated) of an ink sheet, the laser beam being absorbed by the ink sheet and converted into heat, and an image is transferred from an recording material to an intermediate transfer sheet by the converted heat.

Image formation of the present invention is comprising two processes. That is:

(1) A process in which a thermal transfer intermediate transfer medium and an ink sheet are brought into cross contact, and an image is image-wise transferred from an ink sheet by laser exposure.

(2) A process in which a color image is formed on a thermal transfer intermediate transfer medium by repeating the above process plural times, facing the color image with a final image carrying element, and after a thermal transfer intermediate transfer medium and a recording medium being laminated each other by applying heat and/or pressure, an image is transferred together with an image receiving layer to a final image carrying element by delaminating a thermal transfer intermediate medium.

An intermediate transfer type thermal transfer intermediate transfer medium of the present invention is mountable on a large-size proofing machine (Color Decision Type 1 and Type 2 produced by Konica Corp., Final Proof produced by Fuji Photo Film Co., Ltd.) already available on the market, and the utilization therein is a preferable embodiment. In case of using such a large-size color proofing machine available on the market, a process is needed separately in which an image is delaminated and transferred to a final image carrying element after laser recording. In case of utilizing printing paper as a final image carrying element, transfer to a desired recording medium is possible by use of a laminator such as EV-Laminator and EV-Laminator II produced by Konica Corp., and Match Print Laminator 447 produced by Imasion Co. After transfer in this manner, a recorded material very similar to printed matter by delaminating an intermediate transfer type thermal transfer intermediate transfer medium.

A preferable laminator utilized in the present invention is preferably provided with a pressure of from 2 to 98 N/cm and specifically preferably of from 9.8 to 39.2 N/cm. A sufficient transfer quality is hardly achieved when the pressure is not higher than 2 N/cm, while transport characteristics are liable to become worse when it is not lower than 98 N/cm.

A laminating temperature is preferably from 80 to 150° C. and specifically preferably from 90 to 130° C. Fixing quality is liable to be deteriorated when the temperature is not higher than 80° C., while it is not preferable in respect to stability and cost of an apparatus when the temperature is not lower than 150° C.

A laminating speed is preferably from 2 to 50 mm/sec and specifically preferably from 3 to 30 mm/sec. It is not preferable in respect to transport property due to a heavy motor load when the speed is not faster than 2 mm/sec, while it is not preferable that jamming of thin paper is liable to occur when the speed is not slower than 50 mm/sec.

A laminator roller diameter of a laminator is preferably from 10 to 300 mm ϕ and specifically preferably from 30 to 150 mm ϕ. It is not preferable that temperature unevenness is large at the time of transfer when the diameter is not larger than 10 mm ϕ while it is not preferable that heating is time-consuming due to a large heat capacity when the diameter is not smaller than 300 mm ϕ. Further, it is preferable that the higher is a heat transmission of a roller, in case of utilizing the larger diameter of a roller.

A final image carrying element preferably utilized in the present invention refers to printing paper utilized in such as commercial printing, newspaper printing and package printing and to a medium utilized in such as package printing and label printing, and preferably refers to printing paper such as art paper, coated paper, matted paper, light-weight coated paper, slightly coated paper, wood free paper (or fine paper) and medium quality paper. Among them, generally utilized is printing paper having a surface gloss at a incidence angle and reflection angle of 60°, defined by JIS, of from 0.01 to 20, more preferably from 0.05 to 18 and specifically preferably from 0.1 to 15. Further, when an image forming method of the present invention utilizing a thermal transfer intermediate transfer medium is applied to printing paper having Beck smoothness defined in JIS of 0.1 to 20 seconds, more preferably from 0.5 to 18 seconds and specifically preferably from 1 to 15 seconds, it is highly preferable that an image is formed without hurting an appearance of a non-image portion.

Further, a laminator utilized in the present invention is required to have high thermal evenness in its surface and a variation of thermal distribution in a longitudinal direction of lamination is preferably within ±5° C. and specifically preferably within ±3° C. To satisfy such a condition, it is preferred that forced ventilation in a laminator apparatus is not performed and an inlet of a flesh air is shielded as much as possible, and that lamination is performed so as to make a shorter edge of a transferred element be a longitudinal transport direction.

An image recording laser light source of a laser exposure apparatus utilized in the present invention includes such as a semi-conductor laser, a YAG laser, a carbonic acid gas laser and Helium-Neon laser. Among a semi-conductor laser, a so-called single mode laser diode is preferably used, because it is easy to focus $1/e^2$ diameter at a focus into from few $\mu$m to few tens $\mu$m without decreasing optical efficiency significantly. A light emitting diode (LED) is included as a light source other than a laser. An LED and a semiconductor laser are easily utilized as an alley in which plural light emitting elements are integrated. In the present invention, it is preferable to record an image firstly on a laser fusing thermal transfer recording medium provided with a color having been set so that absorption at an exposure wavelength of a recording material is maximum. In laser thermal transfer recording to which the present invention belongs, laser exposure is performed while bringing a thermal transfer recording medium and a medium to be recorded in cross contact (for example, in contact by reduced pressure), and transfer quality is liable to be deteriorated due to an increased amount of gas generated (independent of presence or absence of abrasion) at the time of laser exposure in case that the absorption is large. In case of plural colors are accumulated by recording a monochrome image repeatedly, it is preferable to transfer a color, having a gas generation of more amount, previously, in order to enhance contact quality at the time of exposure as well as to stabilize sensitivity of the second and the following colors. Specifically preferable is to transfer black, having absorption in an infrared region, previously.

A laser scanning method includes such as a cylindrical outer surface scanning, a cylindrical inner surface scanning and a flat-bed scanning. In a cylindrical outer surface scanning, laser exposure is performed while rotating a drum of which a recording material is wound on the outer surface, and rotation of a drum is a main scan and shift of a laser light is a sub scan. In a cylindrical inner surface scanning, a recording material being fixed in the inner surface and a laser beam being irradiated from the inside, and a main scan is performed in a circumferential direction by rotating a part of or the whole of an optical system and a sub scan in a drum axis direction by linearly shifting a part of or the whole of an optical system parallel to a drum axis. In a flat-bed scanning, a main scan of a laser light is performed by combination of such as a polygon mirror or a galvano mirror with a fθ lens and a sub scan is performed by shifting a recording material. A cylindrical outer surface scanning and a cylindrical inner surface scanning are easy to increase precision of an optical system to be suitable to higher resolution recording. In case of a so-called multi-channel exposure in which plural light emitting elements are utilized simultaneously, a cylindrical outer surface scanning is most suitable. Further, in case of utilizing such as a YAG laser having a high exposure power, a cylindrical inner surface scanning is suitable because a revolution of a drum is hardly increased significantly with a cylindrical outer surface scanning.

EXAMPLES

Example 1

In the following, the present invention will be explained according to examples, however, an embodiment of the present invention is not limited thereto. The description of "part" represents "weight part" and "%" represents "weight %", provided being not specifically mentioned.

<Preparation of Ink Sheet>

An ink sheet was prepared according to the following process.

(1) Preparation of Intermediate Layer Coating Solution

Each component shown in the following coating solution composition was subjected to dispersion treatment by use of Paint Shaker (produced by Toyo Seiki Co.) for 1 hour to prepare an intermediate layer coating solution.

<Intermediate Layer Coating Solution>

| | |
|---|---|
| Infrared absorption dye (NK-2014, manufactured by Nippon Hassyoku-shikiso Co.) | 10 parts |
| Binder (Rikacoat SN-20, manufactured by Shin-nippon Rika Co.) | 200 parts |
| N-methyl-2-pyrrolidone | 2000 parts |
| Surfactant (Megafac F-177, manufactured by Dainippon Ink & Chemicals, Inc.) | 1 part |
| Matting agent (MX-150, manufactured by Soken Kagaku Co.; PMMA particles having a number average particle diameter of 1.5 μm) | 6 parts |

(2) Formation of Intermediate Layer on Support

The intermediate layer coating solution described above was coated on one side of the surface of PET film having a thickness of 75 μm and a size of A4 by use of a rotation coater (a whirler), followed by drying the coated material for 2 minutes in an oven at 100° C. to form an intermediate layer having a photo-thermal conversion ability on a support.

An intermediate layer thus obtained had a maximum absorption at the vicinity of 830 nm within a wavelength range of from 700 to 1000 nm, and the absorbance (an optical density: OD) was measured by a Macbeth densitometer to be OD=1.08.

A cross section of an intermediate layer was observed through a scanning type electron microscope to show that a layer thickness of an intermediate layer of a portion where a particle substance was absent was 0.3 μm based on an average. Further, an amount of a particle substance was measured, by calculation from a coating amount, a solid concentration and a thickness of an intermediate layer, to be 60 mg/cm$^2$.

(3) Preparation of Magenta Ink Layer Coating Solution

Each component shown below was subjected to dispersion treatment by use of Paint Shaker (the foregoing) for 2 hours, to prepare a magenta pigment dispersion mother liquid.

<Pigment Dispersion Mother liquid Composition>

| | |
|---|---|
| Acrylic resin (BR105, manufactured by Mitsubishi Rayon Co., Ltd.) | 12.6 parts |
| Magenta pigment (Lionol Red 6B4290G, C. I. Pigment Red 57:1, manufactured by Toyo Ink Co.) | 18 parts |
| Dispersion promoter (Solsuperse S-20000, manufactured by ICI Co.) | 0.8 parts |
| Propyl alcohol | 110 parts |
| Glass beed | 100 parts |

The following each component was mixed while being stirred by a stirrer to prepare a magenta ink layer coating solution.

<Magenta Ink Layer Coating Solution>

| | |
|---|---|
| The above-described pigment mother liquid | 10 parts |
| Propyl alcohol | 60 parts |
| Surfactant (Megafac F-176PF, manufactured by Dainippon Ink & Chemicals, Inc.) | 0.05 parts |

(4) Formation of Magenta Ink Layer

The above-described coating solution was coated on the surface of the above described intermediate layer by use of a whirler for 1 minute, followed by drying the coated material for 2 minutes in an oven at 100° C. to form a magenta ink layer having a thickness of 0.3 μm on an intermediate layer (a layer thickness was measured by use of a scanning type electron microscope in a similar manner to Example 1). An ink layer thus obtained had a maximum absorption (an optical density) of; OD=0.7 (a value through a green filter, measured by a Macbeth densitometer).

By the above processes, there obtained an ink sheet in which a photo-thermal conversion layer, an intermediate layer and a magenta image forming layer having been accumulated successively.

<Preparation of Thermal Transfer Intermediate Transfer Medium>

After the following back-coating layer coating solution was coated and dried on a white PET film (UL9, manufactured by Teijin Ltd.) by use of a wire bar so as to make a dry coating amount 2.5 g/m$^2$, the following cushion layer coating solution 1 was coated and dried on the opposite surface of a back-coating layer by use of an applicator so as to make a dried layer thickness 20 μm to form a cushion layer.

Next, the following intermediate layer coating solution 1 was coated and dried on a cushion layer so as to make dry coating amount 1.0 g/m$^2$, and further on the surface of an intermediate layer was coated and dried the following each image receiving layer coating solution by use of a wired bar so as to make dry coating amount 2.0 g/m$^2$ to prepare a thermal transfer intermediate transfer medium.

In this way, thermal transfer intermediate transfer media 2 to 4 of the present invention and comparative thermal transfer intermediate transfer media 1 and 5 shown in Table 1 were obtained. A back-coating layer of the following composition was applied to all of the thermal transfer intermediate media under the conditions described above.

<Back-Coating Layer Coating Solution>

| | |
|---|---|
| Polyester resin (Vylon 200, manufactured by Toyobo Co., Ltd.) | 9.0 parts |
| PMMA resin particles (MX-1000, manufactured by Soken Kagaku Co.) | 0.3 parts |
| Carbon black (MHI black #273, manufactured by Mikuni Shikiso Co.) 18% MEK dispersion | 3.6 parts |
| Silicone oil (X-24-8300, manufactured by Shin-Etsu Chemical Co., Ltd.) | 2 parts |
| Propyreneglycol monomethylether acetate | 40 parts |
| Toluene | 20 parts |
| Methyl ethyl ketone | 27.1 parts |

<Cushion Layer Coating Solution 1>

| | |
|---|---|
| Polyethylene latex (the foregoing S3127, resin content of 35%) | 100 parts |

<Intermediate Layer Coating Solution 1>

| | |
|---|---|
| Polyethylene latex (S6211, manufactured by Toho Kagaku Co.) (Tg: <30° C., TMA softening point: 65° C., a tensile strength of 150 kg/cm$^2$, an elongation of 250%, a mean particle diameter of 100 nm) | 10.5 parts |
| PMMA particles (MX-300, manufactured by Soken Kagaku Co., volume average primary particle diameter: 3.05 μm, standard deviation: 0.323 μm) | 2.5 parts |
| Water | 87 parts |

In a thermal transfer intermediate transfer medium 1, the following image receiving layer coating solution 1 was coated on the intermediate layer prepared above.

<Image Receiving Layer Coating Solution 1>: Comparison

| | |
|---|---|
| Acrylic resin (BR102, manufactured by Mitsubishi Rayon Co., Ltd.) 30% MEK solution | 66.5 parts |
| Matting agent (Tospearl T130, manufactured by Toshiba Silicone Co.) 10% MEK dispersion solution | 0.65 parts |
| n-Butanol | 32 parts |

In a thermal transfer intermediate transfer medium 2, the following image receiving layer coating solution 2 was coated on the intermediate layer prepared above.

<Image Receiving Layer Coating Solution 2>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 0.65 parts |
| Elecnone 5802A (manufactured by Dainippon Seika Co.) 25% EtOH solution | 8 parts |
| n-Butanol | 32 parts |

In a thermal transfer intermediate transfer medium 3, the following image receiving layer coating solution 3 was coated on the intermediate layer prepared above.

<Image Receiving Layer Coating Solution 3>

| | |
|---|---|
| Acrylic resin (the foregoing BR102) 30% MEK solution | 65.5 parts |
| Matting agent (Tospearl T130, manufactured by Toshiba Silicone Co.) 10% MEK dispersion solution | 0.65 parts |
| Silicone resin (X24-8300, manufactured by Shinetsu Kagaku Co.) 25% xylene solution | 1 parts |
| n-Butanol | 32 parts |

In a thermal transfer intermediate transfer medium 4, the following image receiving layer coating solution 4 was coated on the intermediate layer prepared above.

<Image Receiving Layer Coating Solution 4>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 1.65 parts |
| Silicone resin (X24-8300, manufactured by Shin-Etsu Chemical Co., Ltd.) 25% xylene solution | 8 parts |
| n-Butanol | 32 parts |

In a thermal transfer intermediate transfer medium 5, the following image receiving layer coating solution 5 was directly coated on the cushion layer described above.

<Image Receiving Layer Coating Solution 5>

| | |
|---|---|
| Polycarbonate (manufactured by Mitsubishi Gas Chemical Co., Ltd.: PCZ200) (Tg: from 141 to 149° C., TMA softening point: >200° C., a tensile strength: 69 Mpa, an elongation of 30%) | 13 parts |
| Methyl ethyl ketone | 30 parts |
| Toluene | 57 parts |

<Image Receiving Layer Coating Solution 6>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 0.65 parts |
| Elecnone 5802A (manufactured by Dainippon Seika Co.) 25% EtOH solution | 32 parts |
| n-Butanol | 32 parts |

<Image Receiving Layer Coating Solution 7>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 0.65 parts |
| Elecnone 5802A (manufactured by Dainippon Seika Co.) 25% EtOH solution | 4 parts |
| n-Butanol | 32 parts |

<Image Receiving Layer Coating Solution 8>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 0.65 parts |
| Elecnone 5802A (manufactured by Dainippon Seika Co.) 25% EtOH solution | 2 parts |
| n-Butanol | 32 parts |

<Image Receiving Layer Coating Solution 9>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 0.65 parts |
| Elecnone 5802A (manufactured by Dainippon Seika Co.) 25% EtOH solution | 1 parts |
| n-Butanol | 32 parts |

<Image Receiving Layer Coating Solution 10>

| | |
|---|---|
| Acrylic resin (the foregoing BR102) 30% MEK solution | 60 parts |
| Matting agent (Tospearl T130, manufactured by Toshiba Silicone Co.) 10% MEK dispersion solution | 0.65 parts |
| Elecnone 5802A (manufactured by Dainippon Seika Co.) 25% EtOH solution | 0.5 parts |
| n-Butanol | 32 parts |

<Image Receiving Layer Coating Solution 11>

| | |
|---|---|
| Acrylic resin (the foregoing BR102) 30% MEK solution | 65.5 parts |
| Matting agent (Tospearl T130, manufactured by Toshiba Silicone Co.) 10% MEK dispersion solution | 0.65 parts |
| Silicone resin (X24-8300, manufactured by Shinetsu Kagaku Co.) 25% xylene solution | 36 parts |
| n-Butanol | 32 parts |

<Image Receiving Layer Coating Solution 12>

| | |
|---|---|
| Acrylic resin (the foregoing BR102) 30% MEK solution | 65.5 parts |
| Matting agent (Tospearl T130, manufactured by Toshiba Silicone Co.) 10% MEK dispersion solution | 0.65 parts |
| Silicone resin (X24-8300, manufactured by Shinetsu Kagaku Co.) 25% xylene solution | 4 parts |
| n-Butanol | 32 parts |

<Image Receiving Layer Coating Solution 13>

| | |
|---|---|
| Acrylic resin (the foregoing BR102) 30% MEK solution | 65.5 parts |
| Matting agent (Tospearl T130, manufactured by Toshiba Silicone Co.) 10% MEK dispersion solution | 0.65 parts |
| Silicone resin (X24-8300, manufactured by Shinetsu Kagaku Co.) 25% xylene solution | 0.5 parts |
| n-Butanol | 32 parts |

<Formation of Image>

By utilizing thermal transfer intermediate transfer media No. 1 to 13 obtained, an ink sheet, in addition to an exposing apparatus and a laminator described below, an image was firstly formed on each of thermal transfer intermediate transfer media No. 1 to 13 followed by being transferred onto a final image carrying element.

Exposing apparatus: Color Decision II EV-Laser Proofer II (produced by Konica Corp.), B2 size specification Laminator: Color Decision II EV-Laminator II (produced by Konica Corp.)

Final image carrying element: the following two kinds were used, all the size were B2 specification Matte paper: New Age (manufactured by Oji Seishi Co.); 127.9 g/m$^2$ Wood free paper: NPI wood free (manufactured by Nippon Seishi Co.); 127.9 g/m$^2$ <Finished Appearance of Thermal Transfer Intermediate Medium>

The thermal transfer intermediate transfer media 1 to 5 prepared according to the drying conditions described above were evaluated visually.

A: no problems

B: less than 1/dm$^2$ of defects such as cracks/wrinkles are observed on a thermal transfer intermediate transfer medium C: not less than 1/dm$^2$ of defects such as cracks/wrinkles are observed on a thermal transfer intermediate transfer medium <Sensitivity>

In a system utilized for image formation, exposure was performed after focus adjustment while varying a recording speed under conditions of 23° C. and 50% RH, followed by observing an image secondary transferred on an Tokuryo art paper (produced by Mitsubishi Paper Mills Ltd) through a loupe, and an exposure revolution (rpm) at which a solid image became uniform was defined as a sensitivity. The case that the larger is the value of exposure revolution, indicates the higher sensitivity and the faster recording speed.

<Transferred State of Image Portion and Non-Image Portion>

A transferred state was confirmed totally by visual observation of a transferred state of a solid image portion and a non-image portion after having been re-transferred on each final image carrying element, SEM observation of a cross-section of a final image carrying element, a peeling test of a thermal transfer intermediate transfer medium and an dissolving extraction separation analysis of a thermal transfer intermediate transfer medium.

No-transfer: a state in which an image receiving layer is left on a thermal transfer intermediate transfer medium, Transfer of an image receiving layer: a state in which an image receiving layer does not present on a thermal transfer intermediate transfer medium.

<Gloss of Non-Image Portion>

Gloss of a non-image portion re-transferred onto each final image carrying element was evaluated. Gloss was measured at 60 to 60°, and the measurement method was based on JIS.

A gloss of New Age was 4.5 and that of NPI wood free was 4.0.

A: gloss difference between a non-image portion and paper is less than 10%,

B: gloss difference between a non-image portion and paper is from 10 to 20%,

C: gloss difference between a non-image portion and paper is over 20%.

<Fixing Quality of Non-Image Portion>

After outputting a solid magenta image on a whole of the maximum size of a output exposure machine of B2 size at a correct sensitivity, "Cover UP Tape 652", manufactured by Sumitomo 3M Co., being pasted on an image portion/non-image portion having been secondary transferred onto matte paper and wood free paper, and a peeled-off state was observed visually to be evaluated according to the following criteria.

A: no peeling is observed in both of an image portion/non-image portion,

B: a partial peeling is observed in both of an image portion/non-image portion,

C: a peeling is observed in both of an image portion/non-image portion.

<Transport Property>

After the first sheet was output under conditions of 19° C. and 30% RH, whether the second and the following sheets were transported correctly while sliding on the first sheet without stopping was evaluated according to 3-step criteria.

A: All of the second and following sheets were correctly transported in 5-sheet continuous output, B: Only one of the second and following sheets were not correctly transported in 5-sheet continuous output, C: A transport trouble occurred with all of the sheets.

TABLE 1

| Intermediate transfer medium | Remark | Finish of intermediate transfer medium | Sensitivity | Transfer property | Transfer state of image portion *1 | Transfer state of image portion *2 | Transfer state of non-image portion *1 | Transfer state of non-image portion *2 | Fixing quality of image portion *1 | Fixing quality of image portion *2 | Gloss of non-image portion *1 | Gloss of non-image portion *2 |
|---|---|---|---|---|---|---|---|---|---|---|---|---|
| 1 | Comp. | A | 590 rpm | C | *3 | *3 | *3 | *3 | A | B | C | C |
| 2 | Inv. | A | 600 rpm | A | *3 | *3 | *4 | *4 | A | A | A | A |
| 3 | Comp. | A | 590 rpm | B | *3 | *3 | *4 | *4 | A | A | A | A |
| 4 | Inv. | A | 610 rpm | A | *3 | *3 | *4 | *4 | A | A | A | A |
| 5 | Comp. | A | 480 rpm | A | *4 | *4 | *4 | *4 | C | C | A | A |
| 6 | Comp. | A | 630 rpm | C | *3 | *3 | *3 | *3 | B | B | A | A |
| 7 | Inv. | A | 600 rpm | A | *3 | *3 | *4 | *4 | A | A | A | A |
| 8 | Inv. | A | 600 rpm | B | *3 | *3 | *4 | *4 | A | A | A | A |
| 9 | Inv. | A | 540 rpm | B | *3 | *3 | *4 | *4 | A | A | A | A |
| 10 | Comp. | A | 520 rpm | C | *3 | *3 | *3 | *3 | A | A | C | C |
| 11 | Comp. | B | 610 rpm | C | *3 | *3 | *3 | *3 | B | B | A | A |
| 12 | Inv. | A | 590 rpm | A | *3 | *3 | *4 | *4 | A | A | A | A |
| 13 | Comp. | A | 550 rpm | C | *3 | *3 | *3 | *3 | A | A | C | C |

Comp.; Comparison
Inv.; Invention
*1; Matte paper
*2; Wood free paper
*3; Transfer of image receiving layer
*4; No transfer It is clear from Table 1 that an image forming method of the present invention is excellent in sensitivity and transport property, as well as in a transfer state of an image portion and non-image portion, and is excellent in fixing quality and in gloss of a non-image portion.

According to the present invention, an image forming method which is excellent in sensitivity and transport property, as well as in a transfer state of an image portion and non-image portion, and is excellent in fixing quality and in gloss of a non-image portion, can be provided.

What is claimed is:

1. An image forming method comprising the steps of:

(a) superimposing an ink sheet on an intermediate transfer medium, the ink sheet comprising a thermally transferable ink layer, and the intermediate transfer medium comprising a support having thereon an interlayer and an intermediate image receiving layer in the order;

(b) applying heat with laser light in response to an imagewise signal onto the ink sheet so as to form an ink image on the image receiving layer of the intermediate transfer medium;

(c) peeling off the ink sheet from the intermediate transfer medium having the ink image;

(d) superimposing a final image forming material on the intermediate transfer medium having the ink image; and (e) applying heat or pressure to the superimposed final image forming material on the intermediate transfer medium so as to transfer the ink image onto the final image forming material, wherein the image receiving layer is imagewise transferred to the final image forming material together with the ink image, wherein the image receiving layer of the intermediate transfer medium comprises:

a polymer binder having a molecular weight of 5,000 to 500,000; and an additive compound selected from the group consisting of a wax, a silicone compound, an ester of an aliphatic acid with at least 11 carbon atoms, an amid of an aliphatic acid with at least 11 carbon atoms, an ester of an aromatic carboxylic acid, an ester of phosphoric acid and a fluorinated organic compound, an amount of the additive compound in the image receiving layer being from 3 to 30 weight % based on the total weight of the image receiving layer.

2. The image forming method of claim 1, wherein the thermally transferable ink layer of the ink sheet comprises the same polymer binder as in the image receiving layer of the intermediate transfer medium.

3. The image forming method of claim 1, wherein the additive compound in the image receiving layer of the intermediate transfer medium is selected from the group consisting of a silicone compound, an amid of an aliphatic acid with at least 11 carbon atoms and an ester of phosphoric acid.

4. The image forming method of claim 1, wherein the final image forming material is an actual paper.

* * * * *